US006105539A

United States Patent [19]

Ware et al.

[11] Patent Number: 6,105,539

[45] Date of Patent: Aug. 22, 2000

[54] STEAM GENERATOR TOP OF TUBE BUNDLE DEPOSIT REMOVAL APPARATUS

[75] Inventors: William G. Ware, Ringgold; John F. Wallin, New Salem, both of Ga.

[73] Assignee: ABB Combustion Engineering Nuclear Power, Inc., Windsor, Conn.

[21] Appl. No.: 08/447,375

[22] Filed: May 23, 1995

[51] Int. Cl.[7] ..... F22B 37/48

[52] U.S. Cl. ..... 122/382; 134/167 C; 134/172

[58] Field of Search ..... 122/381, 382, 122/391, 392; 134/167 C, 172, 168 C

[56] References Cited

U.S. PATENT DOCUMENTS

| | | | |
|---|---|---|---|
| 4,445,465 | 5/1984 | Byrd et al. | 122/382 |
| 5,564,371 | 10/1996 | Ashton et al. | 122/392 |
| 5,572,957 | 11/1996 | Vandenberg | 122/382 |
| 5,579,726 | 12/1996 | Finucane | 122/381 |

*Primary Examiner*—Teresa Walberg
*Assistant Examiner*—Gregory A. Wilson
*Attorney, Agent, or Firm*—Ronald P. Kananen; Rader, Fishman & Grauer

[57] ABSTRACT

A deposit removal high pressure spray apparatus for removing heat conduction inhibiting deposits on U-tubes at the top of a shell and tube type of nuclear steam generator (10) tube bundle (16) by crawling along flanged outboard support beams (18) above the U-tubes bundle. The apparatus includes: a crawler (66) with motive means 68 for "inch worm" movement; a rotationally driven base 62 provides movement of the sprayhead to either side of the outboard support beam; a rotationally driven extension arm 60 on rotating base 62 has an elongated reciprocally driven elevator 58 thereon; and, a wrist 52 reversibly and rotatably driven by motor 54*a* sweeps sprayhead 52 with nozzles 56 to clean the top of the bundle 16 tube lanes of 90°, 45° and 135° efficiently.

3 Claims, 5 Drawing Sheets

STEAM GENERATOR TOP OF TUBE BUNDLE DEPOSIT REMOVAL APPARATUS

BACKGROUND OF THE INVENTION

During the operation of shell and tube type of nuclear steam generators having characteristic U-tube bundles, corrosion materials from the various systems tend to settle out in the steam generators. This material forms a layer on the internal components and a portion settles onto the tubesheet where it can be removed by sludge removal operations of the prior art.

Some of this material adheres to the heat exchange tubing where the thickness of this coating gradually increases and eventually degrades the heat exchange characteristics of these tubes. This material forms a scale on the tubes in some plants. Prior art attempts have been made to try to remove the material including shocking the tubes with nitrogen bubbles, varying shutdown routine, chemistry injections and high pressure lancing (spraying) as in U.S. Pat. No. 5,320,072, issued Jun. 14, 1994. None of these have been totally effective and some plants continue to see the degradation increase.

SUMMARY OF THE INVENTION

The present invention is an apparatus to provide high pressure water at the top of the U-tube steam generator tube bundle to mechanically clean that portion of the tubes by removal of deposits. It includes a remotely operated combination of a crawler with motive means for reciprocal driven movement along flanged support beams in the steam generator above the U-tubes; a rotationally driven base for movement of the sprayhead to either side of a support beam; a rotationally driven extension arm on the rotating base; an elongated reciprocally driven elevator on the extension arm movable relative thereto; and, a wrist reversibly and rotatably driven mounted on the elevator and having a sprayhead with nozzles mounted thereon.

The rotational movement of the sprayhead allows the high pressure water jets to be precisely positioned in each tube lane at the top of the U-tube bundle at various angles, 90°, 45° and 135°, of approach. The apparatus elements are installed through the tube bundle access opening and attached to a tube bundle support beam. By travelling along one of the outboard or side support beams on one side of the center tube bundle support beam it delivers high pressure water to all accessible areas on one half of the top of the tube bundle and then is moved to the other side of the center tube bundle support beam for travel along an outboard or side support beam to provide high pressure water to all accessible areas on the second half of the top of the tube bundle. Cameras are utilized to visually aid the remote control of the apparatus operation.

BRIEF DESCRMIION OF THE DRAWINGS

DETAILED DESCRIPTION OF THE PREFERRED EMBODIMENT

Figure 1:
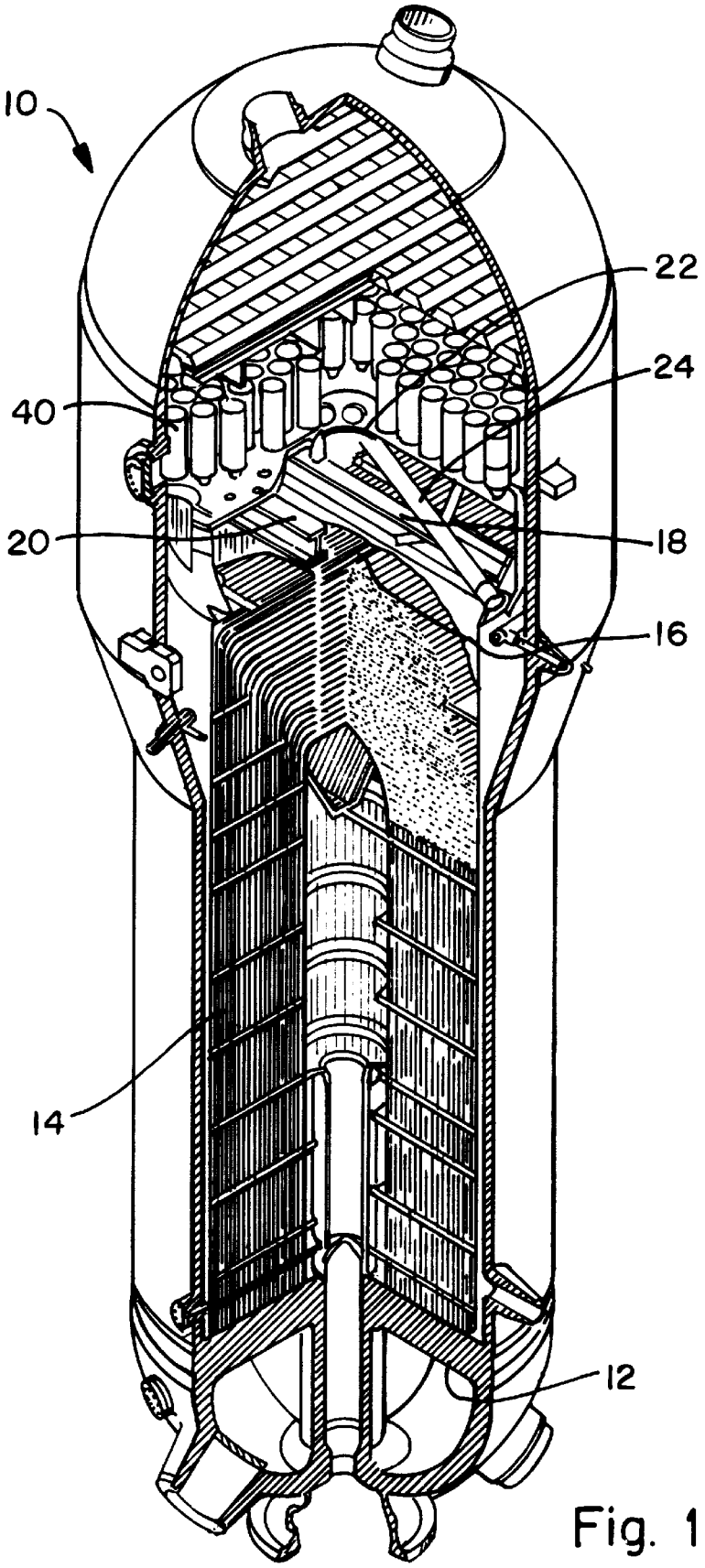
FIG. 1 is an isometric view, broken away, of a nuclear steam generator of the shell and tube type showing the top of the tube bundle and flanged support beams.

As seen in FIG. 1, the numeral 10, generally designates a nuclear steam generator of the shell and tube type with which the apparatus of the invention is to be used. Steam generator 10 includes a tubesheet 12, a U-tube bundle 14, a top of tube bundle 16, a center support beam 18, outboard support beam 20 and a tube bundle access opening 22 having drains 24 attached to the surrounding structure.

Figure 2:
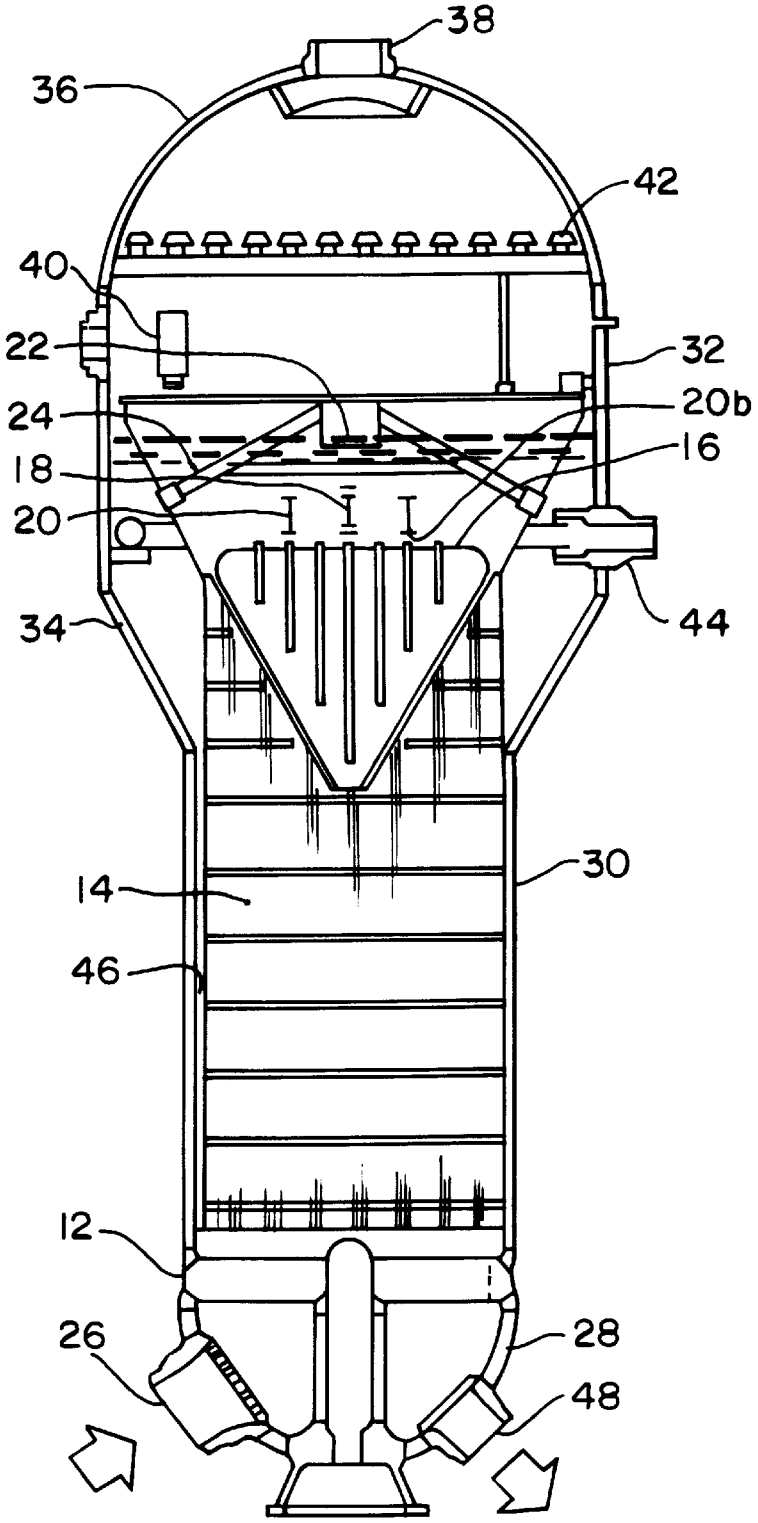
FIG. 2 is a somewhat schematic elevational view of the steam generator of FIG. 1.

The nuclear steam generator 10, as seen in FIG. 2, includes a primary water inlet 26 below tubesheet 12 in the lower and primary head 28. Above the tubesheet 12 is an evaporator shell 30, a steam drum 32 and a cone 34 therebetween. A top head 36 having a steam outlet 38 is located above the steam drum 32.

A plurality of centrifugal steam separators 40 are located in steam drum 32 with dryer screens 42 between them and steam outlet 38.

The feedwater enters inlet 44 and travels through a downcomer annulus 46 to keep the normal water level above the support beams 18 and 20 but below the tube bundle access opening 22. There is a primary water outlet 48 in the primary head 28, as is well understood in the art.

Figure 3:
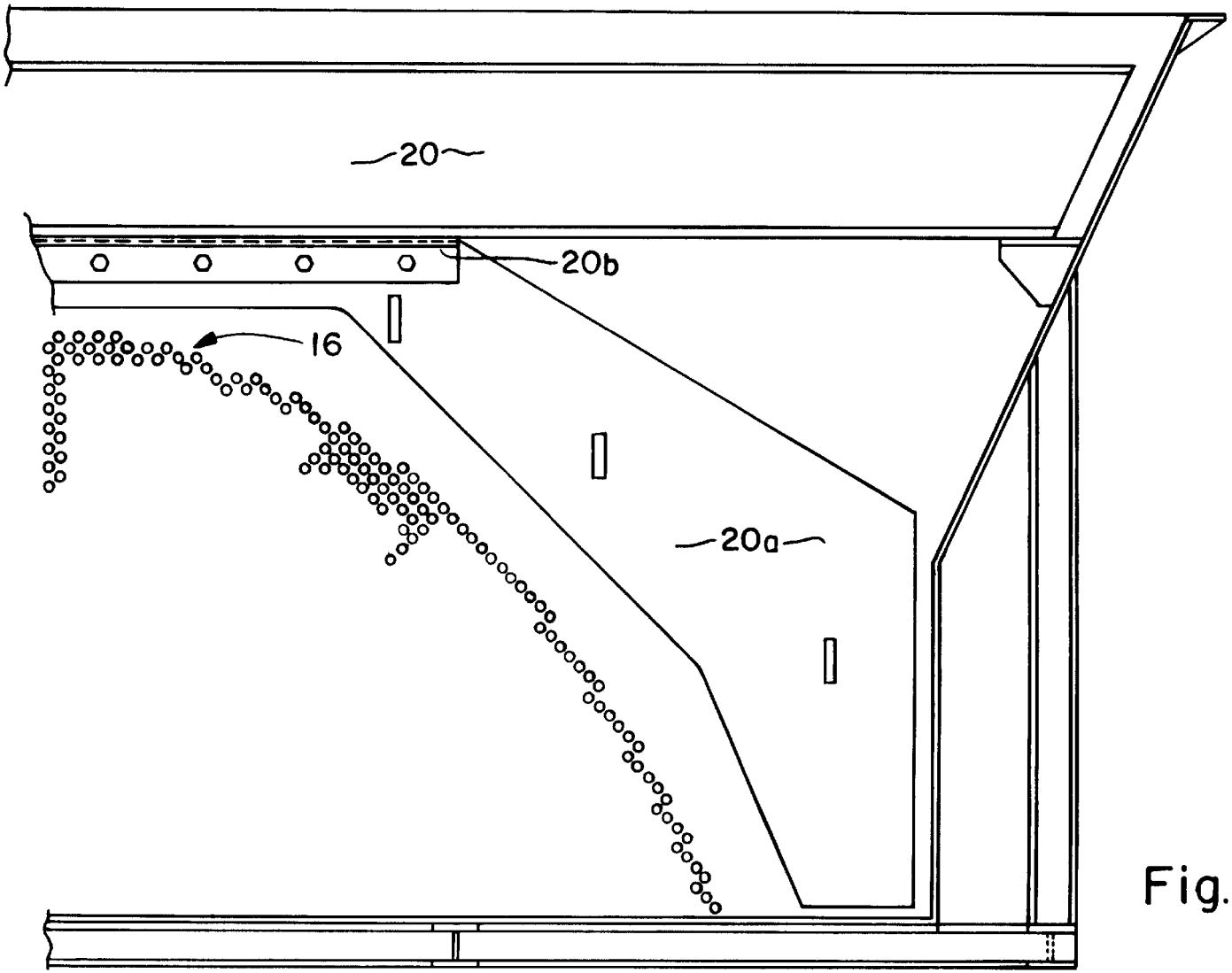
FIG. 3 is a fragmentary and schematic elevational view of a model or mock-up of the steam generator of FIGS. 1 and 2.

FIG. 3 is a drawing of a test mock-up for the invention and contains the simulated outer rows of tubes on the top of the tube bundle. There are three sections in the mock-up containing a block of tubes for spray testing. Two of the blocks are shown in FIG. 3, with 90° or vertical tube lanes and angled or 45° tube lanes illustrated. Support plates 20*a* having pedestals 20*b* at the top thereof for the outboard support beams 20 also can be seen in FIG. 3.

Figure 4A:
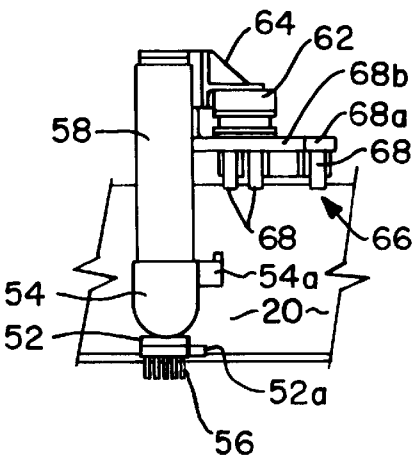
FIG. 4A is a fragmentary and schematic elevational view taken along line A—A of FIG. 4.
Figure 4:
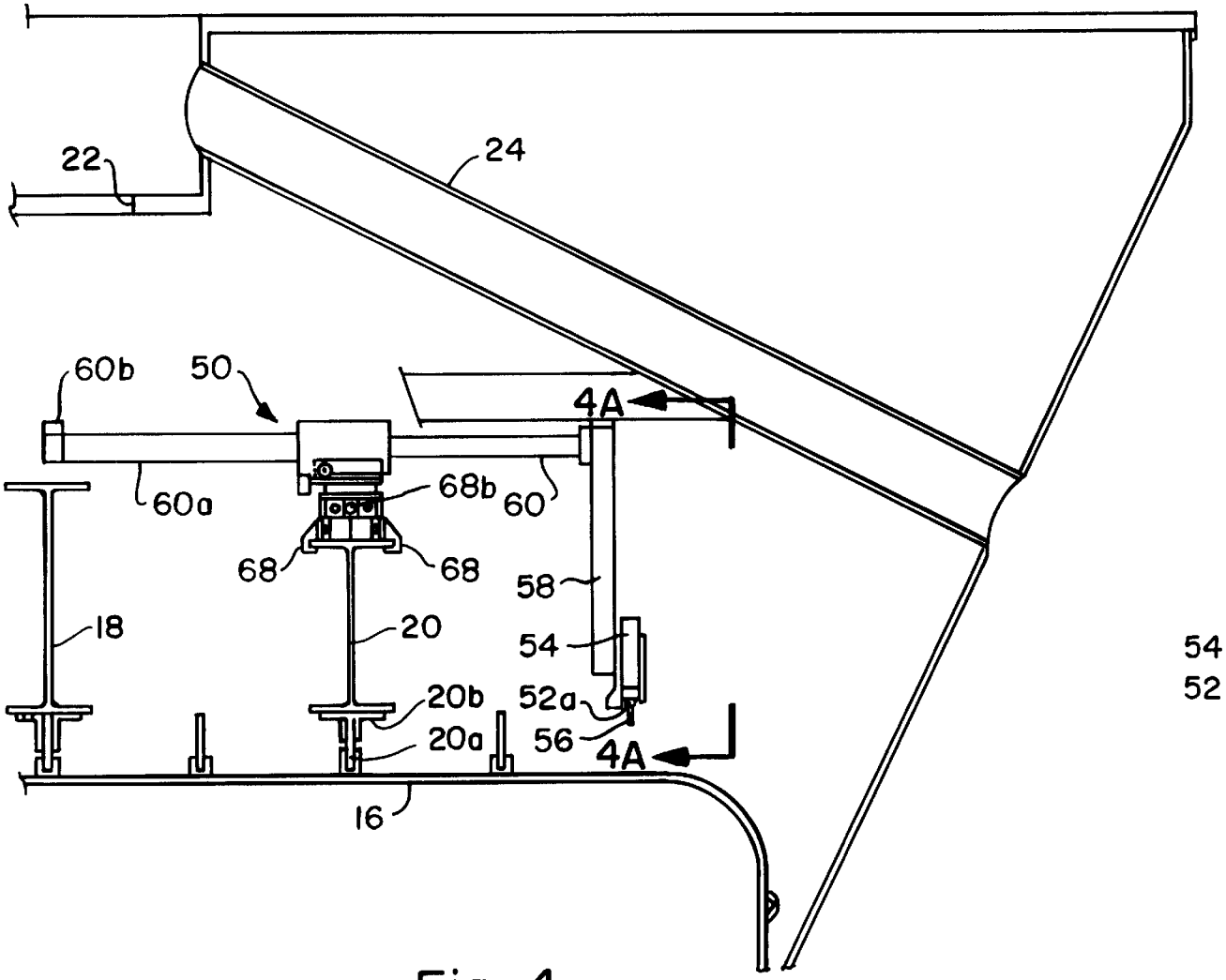
FIG. 4 is a view, in slightly reduced-scale, similar to FIG. 3 at 90° thereto with the apparatus of the invention installed.
Figure 5:
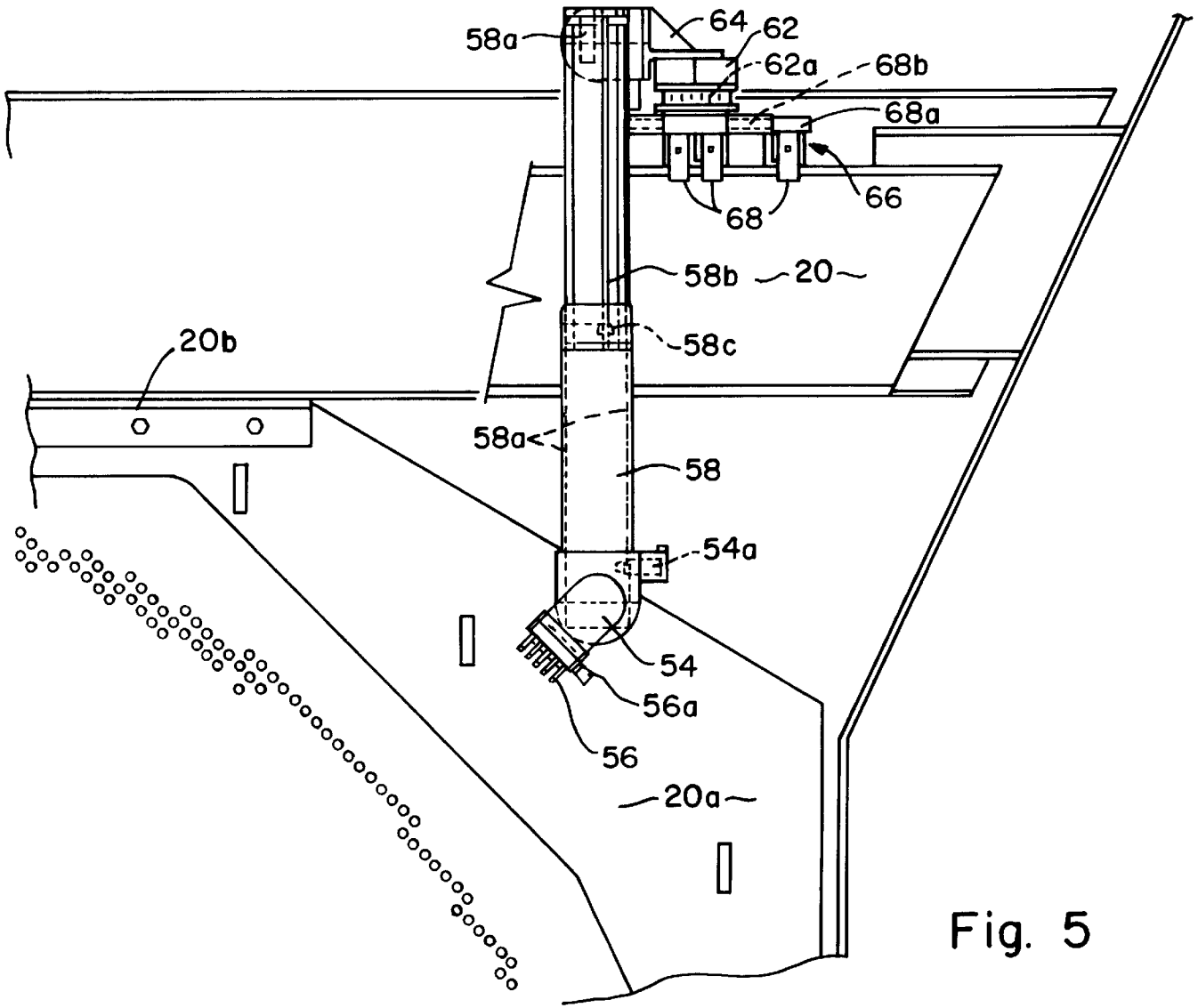
FIG. 5 is a view similar to FIG. 3 with the apparatus of the invention installed.

The deposit removal apparatus of the invention, which is generally designated 50 and shown, for example, in FIGS. 4, 4A and 5, is for removing heat conduction inhibiting deposits on U-tubes at the top 16 of a shell and tube type of nuclear steam generator tube bundle. Water is sprayed from a sprayhead 52 mounted on a wrist 54 from nozzles 56. A swivel hose connection 52*a* connects to the sprayhead 52 and supplies high pressure water to nozzles 56.

The wrist 54 is driven reversibly and rotatably by means of a gear train and an electric or similar motor 54*a* therein which, typically, may be a Globe Model No. 5A509-21 from Globe Motors of 2275 Stanley Avenue, Dayton, Ohio 45404. The wrist 54 is mounted for rotable motion on an elevator 58 which is shown retracted in FIG. 4A and extended in FIG. 5. The elevator 58 is a telescoping structure which rides on guide rods 58*a* as it is driven by a rotating feed screw 58*b* in nut 58*c* mounted in the lower extendable part thereof. The feed screw is gear or belt driven by an electrical motor 58*d* mounted at the top of elevator 58. The motor 58*d* is typically a Globe Model No. 5A517-21.

The elevator 58 is mounted on a rotationally and reciprocally driven extension arm 60 which is supported telescopically on a hollow member 60*a* detachably fixed to a rotating base 62 by means of bracket 64. The arm 60 is extended axially to move elevator 58 by means of an air motor 60*b* mounted on its end opposite elevator 58. The air motor typically may be a Gardner Denver Model No. H-10RM07FF5K made by the Gardner Denver business unit of Cooper Power Tools, P.O. Box 1410, Lexington, S.C. 29072. The rotation of arm 60 to rotate elevator 58 is accomplished by an internal gear driven by a Globe Model No. 5A517-21 electric motor mounted within arm portion 60*a* with an in-line screw.

The rotationally driven base 62 by which the rotationally driven extension arm 60 is moved from one side to the other of an outboard support arm 18, is an electrical motor 62*a* within and driving a circular gear in the base 62. Typically this motor can also be a Globe Model No. 5A517-21.

The elevator 58, the arm 60, and the base 62 are reciprocally driven for movement along said flanged support beams 20 as a unit. The motion is accomplished by two sets of pairs of clamping feet 64, a total of four opposing pairs of feet but one is hidden behind elevator 58 in FIGS. 4A and 5. The sets of feet 64 work independent of each other and are thus capable of producing a mechanical advance by what is well known as an "inch worm" movement along the outboard beams 20. One of the sets of clamps 64 is always engaged. The engaging sets are alternately opened and closed against the flange of a beam 20. A motor driven feed screw 686 allows the alternate driving of non-engaged sets of feet to move and thus the device "crawls" along the support beam 20 and is termed a "crawler".

The crawler, which is generally designated 66, supports the rotating base and includes, in addition to pneumatic cylinders (not shown) to clamp and unclamp the sets of feet 68, a feed screw driving motor 68*a* and the in-line feed screw 68*b*. This motor is, typically, a Globe Model No. 5A509-21.

In using the apparatus of the invention, the crawler 66 is installed first and attaches to the flange of an outboard support beam 20. The rotating extension arm 60 is installed next by attaching it mechanically to the rotating base. A dovetailed end effector attachment used in the nuclear steam generator art for manipulators may be quick and efficient for this purpose. The elevator 58 then is installed and may also be attached by a male or female dovetail connection opening at the top. Since each of the three main elements, the crawler 66, rotating extension arm 60 and elevator 58 are independently powered by small electric and air driven motors, after assembly, air and electrical plug in connections are made and all functions of the apparatus are controlled by an operator from a remote location.

Two cameras (not shown) are utilized for operating the device. The cameras are inserted independently into the steam generator through the tube bundle access opening 22. The cameras attach to the bottom opening of two selected steam separators 40. The cameras are remotely operated with pan, tilt, zoom and focus capabilities in known manner.

The apparatus of the invention is first installed on one of two outboard support beams 20 on top of the bundle 16. All accessible tube lanes on one side of the beam 18 are sprayed utilizing extension capabilities of arm 60. The extension arm 60 then rotates elevator 58 up to clear beam 20. The rotating base moves the elevator to the other side of beam 20 and the process is continued. The apparatus is then manually moved to the other outboard support beam 20 and the entire process repeated.

Thus, a relatively safe and efficient means and method of removing iron oxide deposits from the top of a tube bundle in a shell and tube type U-tube steam generator has been provided.

I claim:

1. A deposit removal apparatus for removing heat conduction inhibiting deposits on U-ubes at the top of a shell and tube type of nuclear steam generator tube bundle (14), wherein water sprayed from a sprayhead (52) under pressure is directed at the U-tubes to remove said deposits, said steam generator including a plurality of flanged supports beams (20) above the U-tube bundle, said apparatus comprising:

a crawler (66) with motive means (68, 68*a, 68b*) for reciprocal driven movement on and along said flanged support beams (20);

a rotationally driven base (62) for movement of the sprayhead (52) to either side of a support beam (20);

a rotationally driven extension arm (60) on said rotating base (62);

an elongated reciprocally driven elevator (58) on said extension arm (60) movable relative thereto;

a wrist (54) reversibly and rotably driven mounted by means (54*a*) on said elevator (58) and having a sprayhead (52) with nozzles (56) mounted thereon.

2. The apparatus of claim 1 in which the crawler 66, the base (62), the extension arm (60), the elevator (58), and the wrist (54) each have independent drive motors (respectively 68*a*, 62*a*, 60*b*, 60*a*, 58*d*, 54*a*).

3. The apparatus of claim 1 in which the crawler (66), the extension arm (60) and the elevator (58) are mechanically connected for easy manual attachment and detachment with and from each other.

* * * * *

UNITED STATES PATENT AND TRADEMARK OFFICE

CERTIFICATE OF CORRECTION

PATENT NO. : 6,105,539
DATED : August 22, 2000
INVENTOR(S) : William G. Ware et al.

It is certified that error appears in the above-identified patent and that said Letters Patent is hereby corrected as shown below:

Column 4, claim 1,
Line 15, et seq., should read;
1. A deposit removal apparatus for removing heat conduction inhibiting deposits on u-tubes at the top of a shell and tube type of nuclear steam generator tube bundle (14), wherein water sprayed from a sprayhead (52) under preassure is directed at the u-tubes to remove said deposits, said steam generator including a plurality of flanged support beams (20) above the u-tube bundle, said apparatus comprising:

a crawler (66) with motive means (68, 68a, 68b) for reciprocal driven movement on and along said flanged support beam (20);

a rotationally driven base (62) for movement of the sprayhead (52) to either side of the support beam (20);

a rotationally driven extension arm (60) on said rotating base (62); an elongated reciprocally driven elevator (58) on said extension arm (60) movable relative thereto; a wrist (54) reversibly and rotatably driven mounted by means (54a) on said elevator (58) and having a sprayhead (52) with nozzles (56) mounted thereon.

Column 4,
Line 37, et seq., claim 2, should read;
2. The apparatus of claim 1 in which the crawler (66), the base (62), the extension arm (60), the elevator (58), and the wrist (54) each have independent drive motors (respectively 68a, 62a, 60b, 60a, 58d, 54a).

Signed and Sealed this

Eighteenth Day of September, 2001

*Attest:*

Nicholas P. Godici

NICHOLAS P. GODICI
*Acting Director of the United States Patent and Trademark Office*

*Attesting Officer*